United States Patent [19]

Blenski et al.

[11] Patent Number: 4,909,141

[45] Date of Patent: Mar. 20, 1990

[54] PRESSING DEVICE

[75] Inventors: Hans-Jürgen Blenski, Dortmund; Klaus Janberg, Ratingen; Dieter Rittscher, Essen, all of Fed. Rep. of Germany

[73] Assignee: GNS Gesellschaft für Nuklear-Service mbH

[21] Appl. No.: 229,139

[22] Filed: Aug. 5, 1988

[30] Foreign Application Priority Data

Feb. 5, 1987 [DE] Fed. Rep. of Germany ..... 3703421

[51] Int. Cl.[4] ..... B03B 7/00

[52] U.S. Cl. ..... 100/244; 100/215; 100/218; 100/264; 100/902; 100/918; 100/137; 376/260; 72/403

[58] Field of Search ..... 376/260, 261, 272; 100/902, 918, 295, 244, 264, 137, 215, 218; 72/403; 83/923; 252/633

[56] References Cited

U.S. PATENT DOCUMENTS

| | | | |
|---|---|---|---|
| 3,589,276 | 6/1971 | Swallert | 100/137 |
| 4,106,322 | 8/1978 | Moshnin et al. | 72/403 |
| 4,470,346 | 9/1984 | Nelson | 100/295 |
| 4,475,449 | 10/1984 | Gianelo | 100/902 |
| 4,588,003 | 5/1986 | Kaldenbach | 100/295 |
| 4,601,238 | 6/1986 | Davis, Jr. et al. | 100/295 |
| 4,809,600 | 3/1989 | Yamamoto et al. | 100/902 |

*Primary Examiner*—Daniel Wasil

*Attorney, Agent, or Firm*—Toren, McGeady & Associates

[57] ABSTRACT

A device for pressing cylindrical containers holding nuclear facility waste materials into disk pellets includes an initial press and a main press. In the initial press, the container is deformed by an arrangement of movable dies and tension-relieving rams into a shape suitable to fit into a compaction chamber in the main press. After the container is collapsed by the dies and rams of the initial press, the initial press is opened and the collapsed container is deposited into the compaction chamber of the main press where it is compacted into a disk-like pellets and discharged from the compaction chamber.

5 Claims, 3 Drawing Sheets

PRESSING DEVICE

Figure 1:
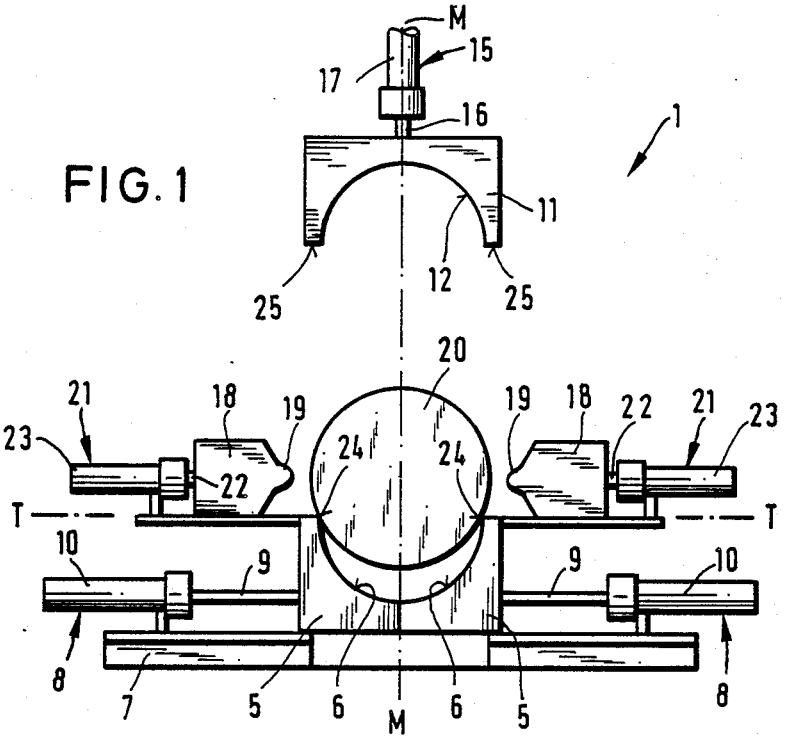

The invention is directed to a device for pressing cylindrical containers serving to receive waste materials from nuclear facilities into disk-like pellets according to the characteristic features in the preamble of claim 1.

In order to store the waste occurring in nuclear facilities, such as paper, wood, plastics material, metals, concrete, rubble and the like, in a correct manner with respect to environmental and safety techniques, it is known to store this waste in cylindrical containers, particularly barrels. For reasons relating to handling and storage, a determined container size is generally used. In view of the waste quantities which increase as the number of nuclear facilities increases, together with the fact that available storage capacities for such containers which satisfy the conditions regarding safety techniques are constantly decreasing, these containers are now being compacted together with their contents into disk-like pellets, specifically to an order of magnitude such that two or more pellets can be stored, in turn, in due order in one cylindrical container. In this way, the available storage space can be utilized in a manner which is considerably more economical.

However, in practice, in contrast to the containers for waste materials from nuclear facilities whose internal and external diameters are standardized to a great extent and, in particular, also because of the international contact between operators of nuclear power plants, containers are used whose external diameters are greater than the standard containers and, accordingly, these containers no longer fit into the feed chamber of the pressing device, so that they can also not be pushed out of the feed chamber into the compaction space with the aid of the pressing ram so as to be pressed into pellets in the compaction space.

Of course, it would be possible to prepare pressing devices for these larger containers, also, which are correspondingly designed on the basis of the dimensions of the feed chamber and the compaction space, but this would necessarily be connected with a greater expenditure which, in many cases, and also for reasons of space, cannot be satisfactory, since the space for an additional device is not available.

The present invention is based on the problem of constructing the device described in the preamble of claim 1 in such a way that, in addition to the standard containers, containers having a greater external diameter can also be pressed into disk-like pellets easily.

The solution to this problem consists, according to the invention, in the characteristic features named in the characterizing part of claim 1.

In order that containers having a greater external diameter can likewise easily be pressed into such pellets having a uniform external diameter for the purpose of storage in standard containers, an initial press is now arranged prior to the actual press, in which initial press the containers are reduced in diameter so as to be easily introduced into the feed chamber of the initial press. For this purpose, the containers having greater diameters are first compressed laterally by means of the tension-relieving ram, which is arranged so as to be movable in a transverse direction. The container accordingly loses its rigidity. This relieving of tension can be carried out easily in the overwhelming majority of cases because the contents of the container are compressible and the containers can accordingly be compressed in the direction of their longitudinal axis approximately in the area of the plane of their greatest diameter. Following this, it is then likewise easily possible, by means of moving the upper and bottom dies together, to reduce the relaxed container, together with its contents, to a diameter which allows it to be introduced into the feed chamber in an unobjectionable manner.

In this tension-relieving process, the two bottom dies are first moved together so that, together, they form a half-shell which is closed at the bottom. The tension-relieving ram is subsequently moved transversely out of the receiving area of the half-shell. The one-piece upper die is then moved away in an upward direction. A container can now be introduced into the initial press, wherein this container can be supported on the inner longitudinal edges of the half-shell because of the larger external diameter. The upper die is then immediately moved toward the bottom dies far enough so that the container to be deformed can no longer move out of the way. Following this, the tension-relieving ram is pressed against the wall of the container continuously or in a sudden manner, possibly with alternating frequency, and deforms the wall inwardly. The container accordingly loses its stability. After the tension-relieving ram subsequently moves back laterally into its initial position, the upper die is moved onto the bottom die completely, so that a press chamber is formed which is also closed in the front and in which the container is reduced to a size corresponding to the space in the feed chamber and in the compaction space of the main press, respectively.

After the container is reduced, the bottom dies are moved away from one another laterally, so that the deformed container can fall down between the bottom dies into the feed chamber of the press.

The initial press is ready for a new tension-relieving process by means of raising the upper die and then moving the bottom dies together.

The relieving of tension and relaxing of rigidity, respectively, of the containers having greater diameters is further improved and simultaneously facilitated with the characteristic features of claim 2, since the tension-relieving rams are moved toward the container in two areas located opposite one another.

In order to ensure the relaxing of rigidity of the containers along their entire length, the characteristic features of claim 3 are provided. In this way, the load exerted on the tension-relieving ram is brought to bear on the containers in a practically linear manner and the containers are pressed in with a specifically smaller expenditure of force.

The hydraulic displacement of the dies and the tension-relieving rams, according to the characteristic features of claim 4, leads to a clear arrangement of the diverse units. Maintenance is comparatively simple an also easy to carry out. If the cylinders which are acted upon hydraulically are damaged, they can easily be repaired and also exchanged temporarily, as required.

The characteristic features of claim 5 prevent damage to the initial press, as well as the main press. Containers with waste which cannot be pressed, particularly solid structures, for example, ay be the reason why one of the dies or a tension-relieving ram does not reach its end position. The overload protection can be connected with a signal lamp or an acoustic signal which indicate the overload condition, so that manual intervention can possibly be effected in the initial pressing and main pressing processes, which preferably occur automatically, and the problem container can be examined and possibly removed.

Figure 2:
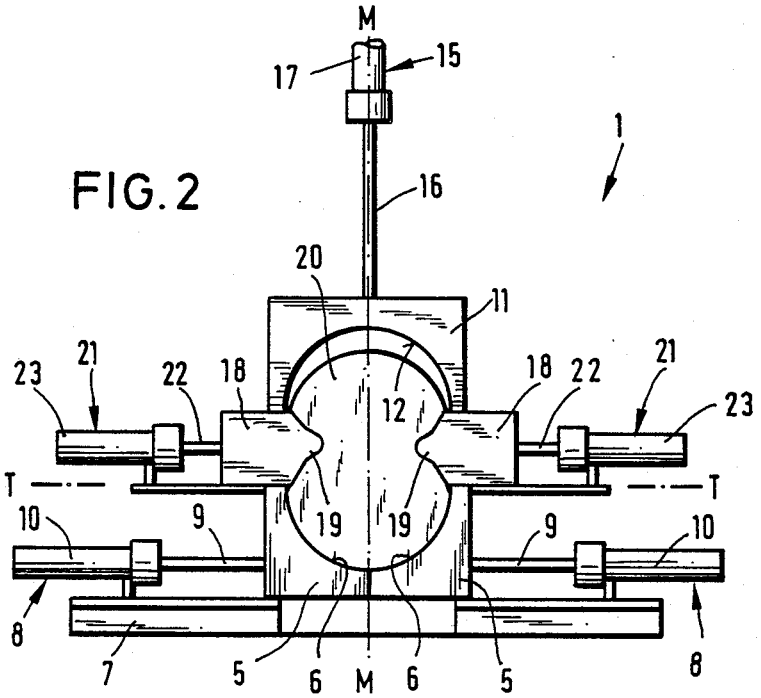
Figure 3:
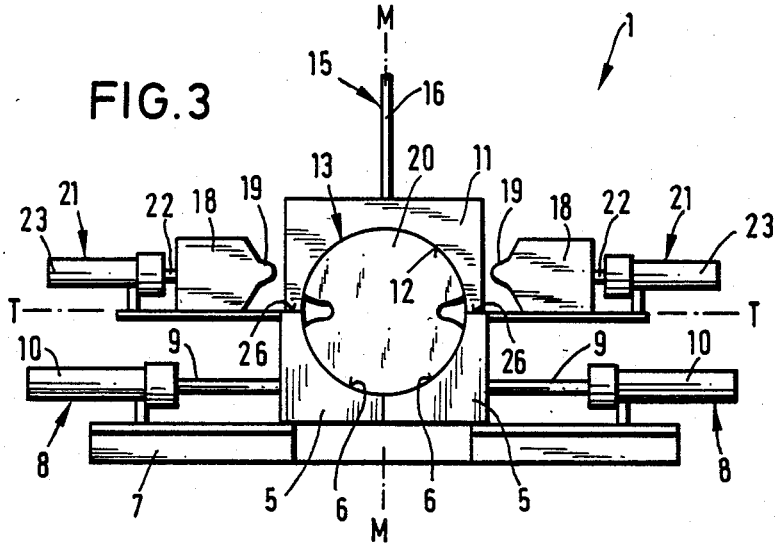
Figure 4:
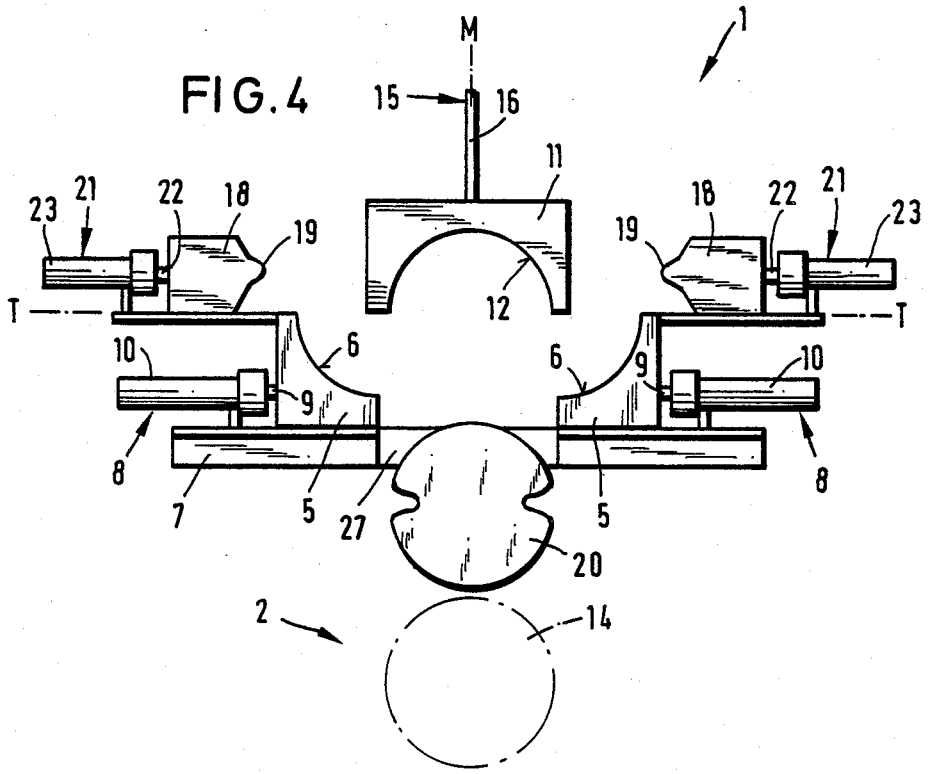
Figure 5:
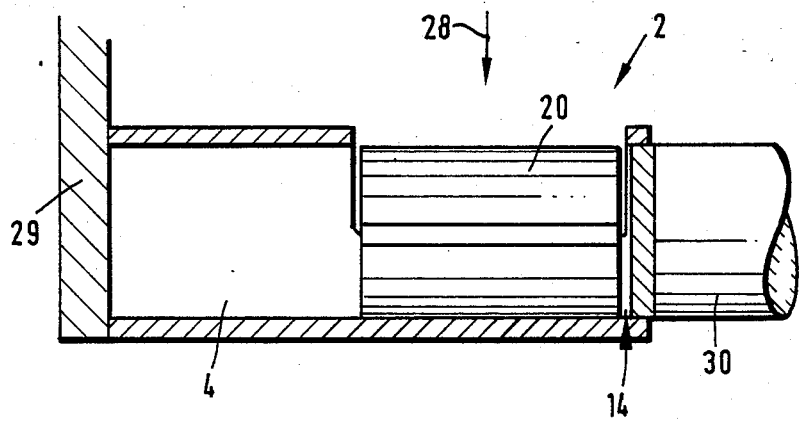

The invention is explained in more detail in the following with the aid of an embodiment example shown in the drawings. FIG. 1 shows, in a schematic manner, an opened initial press, according to the invention, of a container to be relieved of rigidity; FIG. 2 shows the initial press of FIG. 1 after the lateral compression of the container; FIG. 3 shows the initial press of FIGS. 1 and 2 after the initial compaction of the container; FIG. 4 shows the initial press of FIGS. 1 to 3 during the ejection of the initially compacted container; FIG. 5 shows a main press arranged below the initial press in schematic longitudinal section in the initial position and FIG. 6 shows the main press, according to FIG. 5, in the end position.

Figure 6:
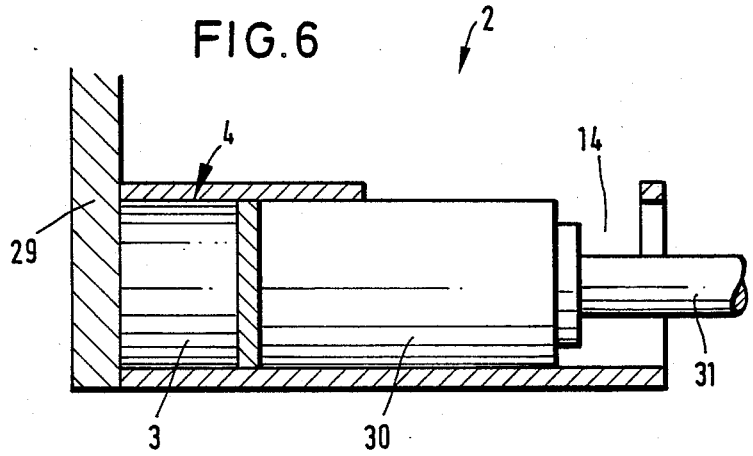

An initial press, which is arranged above a main press 2 seen in FIGS. 5 and 6, is designated by 1 in FIGS. 1 to 4. The main press 2 is used for the production of disk-like pellets 3 of a predetermined diameter from barrels containing the waste materials from nuclear facilities. Such waste materials are composed of paper, wood, plastics material, metals, concrete, rubble, etc.

In order that barrels having a greater external diameter than the diameter of the compaction space 4 of the main press 2 can also be pressed into pellets 3 in the main press 2, according to FIGS. 5 and 6, such barrels are relieved of rigidity and reduced in diameter together with their contents in the initial press 1, according to FIGS. 1 to 4.

For this purpose, the initial press 1 comprises two transversely movable bottom dies 5. These bottom dies 5, which are provided with recesses 6 resembling quarter-circle segments, are positively guided at the frame 7 of the initial press 1 and are displaceable by means of cylinders 8 which can be acted upon hydraulically. The piston rods 9 of the cylinders 8 abut at the bottom dies 5. The cylinder housings 10 are fixed at the press frame 7.

In addition, the initial press 1 comprises a one-piece upper die 11 with a recess 12 resembling a half-circle segment. In the state in which they are moved together (FIG. 3), the upper die 11 and bottom dies 5 form a press space 13 which is also closed on the end and corresponds in its dimensions to the feed chamber 14 of the main press 2.

The upper die 11 is positively guided in a vertical direction at the frame 7 of the initial press 1 in a manner not shown in more detail. The displacement is effected with the aid of at least one cylinder 15 which is acted upon hydraulically. The piston rod 16 of the cylinder 15 abuts at the upper die 11, while the cylinder housing 17 is supported at the press frame 7.

At a slight distance above the separation plane T—T between the upper die 11 and the bottom dies 5, two tension-relieving rams 18 are positively guided horizontally at the press frame 7 so as to be arranged diametrically with reference to the vertical center longitudinal plane M—M of the press frame 7. The tension-relieving rams 18 comprise flange-like pressure strips 19 on front faces which face one another, which pressure strips 19 extend along the entire length of a barrel 20 to be relieved of rigidity.

The displacement of the tension-relieving rams 18 is effected by means of cylinders 21 which are acted upon hydraulically. The piston rods 22 of the cylinders 21 abut at the tension-relieving rams 18 and the cylinder housings 23 at the press frame 7.

In order to relieve a barrel 20 of rigidity, the two bottom dies 5 are first moved together, according to FIG. 1, so that together they form an upwardly open half-shell. The tension-relieving rams 18 are moved away to the sides by means of drawing in the cylinders 21 and the upper die 11 is moved upward. A barrel 20 to be relieved of tension is now introduced into the initial press 1 with the aid of an inserting device, not shown, so that it comes to rest, according to FIG. 1, on the inner longitudinal edges 24 of the bottom dies 5.

By means of acting upon the cylinder 15 in the moving out direction, the upper die 11 is then lowered enough so that the end faces 25 of the upper die 11 come to rest in a plane in which they do not impede the transverse displacement of the tension-relieving rams 18 (FIG. 2), but prevent the barrel 20 from moving out of the way.

The tension-relieving rams 18 are now pressed against the barrel 20 laterally by means of the cylinders 21, wherein the wall of the barrel 20 is compressed in a V-shaped manner, taking into account the compressibility of the contents of the barrel 20. The barrel accordingly loses its rigidity (FIG. 2).

Following this, the tension-relieving rams 18 are moved away again from the dies 5, 11 laterally, corresponding to FIG. 3, by means of drawing in the cylinders 21. Accordingly, the path is opened for completely lowering the upper die 11 until its end faces 25 come to rest at the end faces 26 of the bottom dies 5 (FIG. 3). In this way, the barrel 20, whose rigidity is relaxed, is reduced to a diameter which enables it to be introduced into the main press 2.

For this purpose, the bottom dies 5 are moved away from one another laterally corresponding to FIG. 4, so that the barrel 20, whose rigidity is relaxed and which is compressed, can fall down into the feed chamber 14 of the main press 2 through a recess 27 in the press frame 7. In FIG. 4, this feed chamber 14 is indicated in dash-dot lines.

Thus, a pre-compacted barrel 20, whose rigidity is relaxed, exits the initial press 1 and arrives in the feed chamber 14 of the main press 2 corresponding to the arrow 28 in FIG. 5. The feed chamber 14 is constructed in the manner of a shell and is open at the top. Its length is dimensioned in such a way that a pre-compacted barrel 20 can be received easily.

A compaction space 4, which is closed along the circumference, is connected to the feed chamber 14. The diameter of the compaction space 4 corresponds to the internal diameter of those barrels in which the pellets 3 are to be stored.

The compaction space 4 is defined on the one front side by means of a wall portion 29 which is displaceable transversely relative to the longitudinal direction of the compaction space 4 and simultaneously exerts an abutment function.

A pressing ram 30 is guided so as to be displaceable in the longitudinal direction of the compaction space 4 and the feed chamber 14. The pressing ram 30 is under the influence of at least one cylinder which is acted upon hydraulically, only the piston rod 31 of the cylinder is shown in FIG. 6.

After a pre-compacted barrel 20 is inserted into the feed chamber 14, according to FIG. 5, this cylinder is acted upon and the pressing ram 30 is moved in the longitudinal direction of the feed chamber 14. The barrel 20 is accordingly pushed into the compaction space 4 until it contacts the abutment 29. The barrel 20, together with its contents, is then pressed into a disk-like pellet 3 by means of the continued movement of the pressing ram 30 (FIG. 6).

After the production of the pellet 3, the abutment 29 is moved away from the front side of the compaction space 4 and the pellet 3 is ejected out of the compaction space 4 by means of the pressing ram 30.

Following this, the pressing ram 30 is returned to the initial position and the abutment is brought in front of the front side of the compaction space 4, so that the main press 2 is then also ready to receive a pre-pressed tension-relieved barrel 20 again.

Of course, waste materials without containers can also be pressed into pellets 3 by means of the main press 2.

LIST OF REFERENCE NUMBERS 1 initial press
2 main press
3 pellets
4 compaction space
5 bottom dies
6 recesses in 5
7 frame of 1
8 cylinder for 5
9 piston rod of 8
10 housing of 8
11 upper die
12 recess in 11
13 press space between 5 and 11
14 feed chamber of 2
15 cylinder for 11
16 piston rod of 15
17 housing of 15
18 tension-relieving rams
19 pressure strips at 18
20 barrel
21 cylinder for 18
22 piston rod of 21
23 housing of 21
24 longitudinal edges of 11
25 end faces of 11
26 end faces of 5
27 recess in 7
28 arrow
29 wall portion
30 pressing ram
31 piston rod
T—T separation plane
M—M center longitudinal plane

We claim:

1. Device for pressing cylindrical containers for receiving waste materials from nuclear facilities into disk-like pellets, having a cylindrical compaction space which is defined on one front side by a displaceable wall portion and on the other front side by a shell-like feed chamber which is open at the top, wherein a pressing ram is guided so as to be displaceable in the longitudinal direction of the feed chamber and the compaction space, characterized in that an initial press (1) is arranged above the feed chamber (14), which initial press (1) comprises two bottom dies (5), which are movable in a transverse direction and are provided with recesses (6) resembling quarter-circle segments, a vertically movable upper die (11) having a recess (12) resembling a half-circle segment, and at least one tension-relieving ram (18) which is arranged above a separation plane (T—T) between the bottom dies and the upper die so as to be movable transversely between the bottom dies (5) and the upper die (11).

2. Device according to claim 1, characterized in that two tension-relieving rams (18) are provided in the same vertical plane in a diametrical arrangement.

3. Device according to claim 1 or 2, characterized in that each tension-relieving ram (18) comprises a flange-like pressure strip (19) which faces a press chamber (13) of the initial press (1).

4. Device according to claim 3, characterized in that the bottom dies (5), the upper die (11) and each tension-relieving ram (18) are displaceable by means of cylinders (8, 15, 21) which can be acted upon hydraulically.

5. Device according to claim 4, characterized in that the cylinders (8, 15, 21) are provided with an overload protection.

* * * * *